US011033804B1

(12) United States Patent
Lipscomb

(10) Patent No.: US 11,033,804 B1
(45) Date of Patent: Jun. 15, 2021

(54) GRAVITY DROP BALL GAME SYSTEM

(71) Applicant: Joseph M. Lipscomb, Sebring, FL (US)

(72) Inventor: Joseph M. Lipscomb, Sebring, FL (US)

( * ) Notice: Subject to any disclaimer, the term of this patent is extended or adjusted under 35 U.S.C. 154(b) by 0 days.

(21) Appl. No.: 16/743,424

(22) Filed: Jan. 15, 2020

Related U.S. Application Data

(60) Provisional application No. 62/803,690, filed on Feb. 11, 2019.

(51) Int. Cl.

| | |
|---|---|
| ***A63F 7/06*** | (2006.01) |
| ***A63F 7/28*** | (2006.01) |
| ***A63B 57/40*** | (2015.01) |
| ***A63B 67/02*** | (2006.01) |

(52) U.S. Cl.
CPC ..... *A63F 7/0628* (2013.01); *A63F 7/28* (2013.01); *A63B 57/40* (2015.10); *A63B 67/02* (2013.01)

(58) Field of Classification Search
CPC ..... A63F 7/0628; A63F 7/28; A63B 57/40; A63B 67/02
See application file for complete search history.

(56) References Cited

U.S. PATENT DOCUMENTS

| | | | | | |
|---|---|---|---|---|---|
| 1,388,059 | A * | 8/1921 | Richman | A63F 7/3622 | 446/168 |
| 3,884,469 | A * | 5/1975 | Morton | A63F 7/0628 | 273/108.21 |
| 3,980,302 | A * | 9/1976 | Meyer | A63F 7/0628 | 273/108.2 |
| 4,275,886 | A * | 6/1981 | Bannon | A63B 69/3661 | 473/180 |
| 4,834,385 | A * | 5/1989 | Jackson | A63F 7/048 | 273/144 A |
| 5,370,391 | A * | 12/1994 | Hilzendeger | A63F 7/3622 | 273/112 |
| 2006/0046837 | A1* | 3/2006 | Ito | G07C 15/001 | 463/22 |
| 2020/0215423 | A1* | 7/2020 | Hauck | A63F 7/3622 | |

* cited by examiner

*Primary Examiner* — Michael D Dennis

(57) ABSTRACT

A dispensing assembly includes a cradle above for supporting and dispensing a plurality of balls. The dispensing assembly also includes an output ramp below. The dispensing assembly also includes a guide rail with a spiral section extending downwardly from the cradle to the output ramp. A receiving assembly includes an input ramp below and a cup above. The plurality of balls are positioned in the cradle for being fed by a player down the guide rail, down the output ramp, and hopefully, up the input ramp into the cup.

3 Claims, 4 Drawing Sheets

FIG. 7
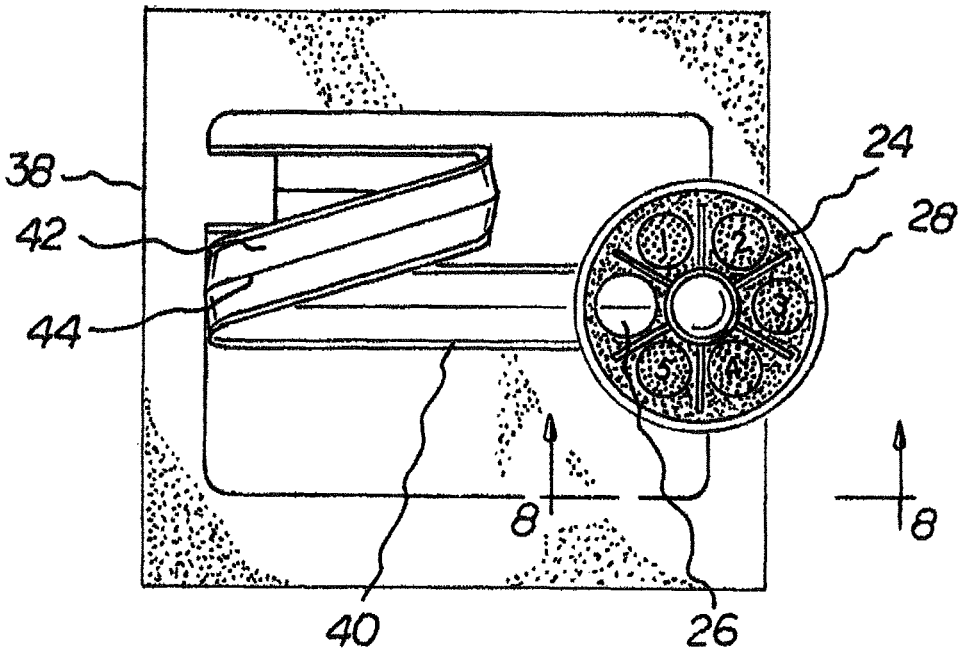
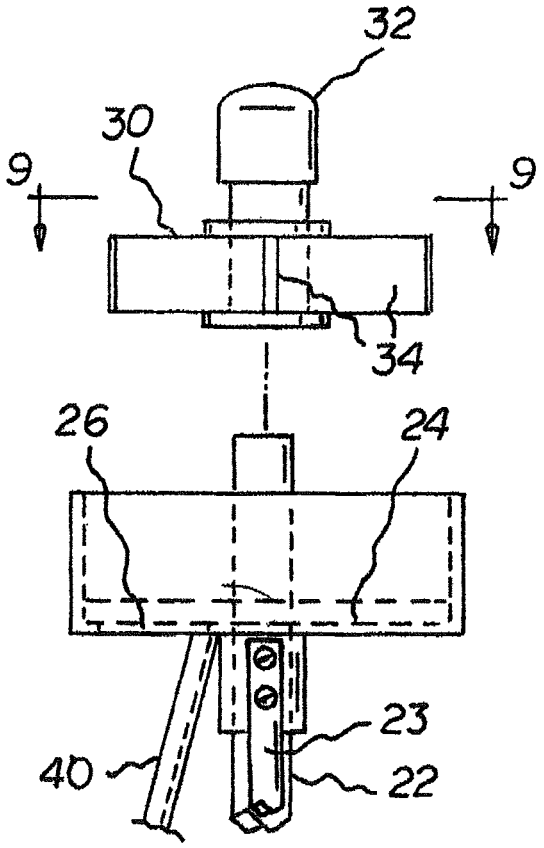
FIG. 8
FIG. 9
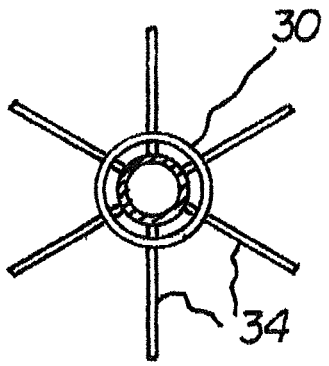
FIG. 10
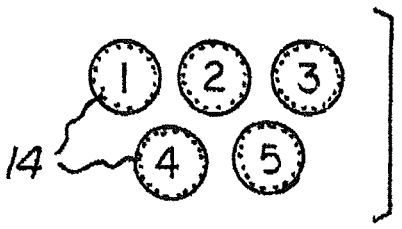

GRAVITY DROP FIVE BALL GOLF

SCORE SHEET

| Player One | Player Two | Player Three |
|---|---|---|
| _____ | _____ | _____ |
| 1._____ | 1._____ | 1._____ |
| 2._____ | 2._____ | 2._____ |
| 3._____ | 3._____ | 3._____ |
| _____ | _____ | _____ Totals |

| Player Four | Player Five | Player Six |
|---|---|---|
| _____ | _____ | _____ |
| 1._____ | 1._____ | 1._____ |
| 2._____ | 2._____ | 2._____ |
| 3._____ | 3._____ | 3._____ |
| _____ | _____ | _____ Totals |

*FIG. 11*

GRAVITY DROP BALL GAME SYSTEM

RELATED APPLICATION

This application is based upon Provisional Patent Application No. 62/803,690 filed Feb. 11, 2019, entitled "Gravity Drop Ball Game System", which is incorporated herein by reference and the priority of which is claimed.

BACKGROUND OF THE INVENTION

Field of the Invention

The present invention relates to a gravity drop ball game system and more particularly pertains to testing skills of a player and generating competition between players and teams in a safe, convenient, and economical manner.

Description of the Prior Art

The use of golf games of known designs and configurations is known in the prior art. More specifically, golf games of known designs and configurations previously devised and utilized for the purpose of testing skills of players and generating competition between players are known to consist basically of familiar, expected, and obvious structural configurations, notwithstanding the myriad of designs encompassed by the crowded prior art which has been developed for the fulfillment of countless objectives and requirements.

While these devices fulfill their respective, particular objectives and requirements, they do not describe a gravity drop ball game system that tests skills of a player and generates competition between players and teams in a safe, convenient, and economical manner.

In this respect, the gravity drop ball game system according to the present invention substantially departs from the conventional concepts and designs of the prior art, and in doing so provides an apparatus primarily developed for the purpose of testing skills of a player and generating competition between players and teams in a safe, convenient, and economical manner.

Therefore, it can be appreciated that there exists a continuing need for a gravity drop ball game system which can be used for testing skills of a player and generating competition between players and teams in a safe, convenient, and economical manner. In this regard, the present invention substantially fulfills this need.

SUMMARY OF THE INVENTION

In view of the disadvantages inherent in the known types of golf games of known designs and configurations now present in the prior art, the present invention provides a gravity drop ball game system. As such, the general purpose of the present invention, which will be described subsequently in greater detail, is to provide a gravity drop ball game system and method which has all the advantages of the prior art and none of the disadvantages.

To attain this, in a broad context, first provided are a plurality of balls. Next, a dispensing assembly is provided. The dispensing assembly includes a cradle above for supporting and dispensing the plurality of balls. The dispensing assembly also includes an output ramp below. The dispensing assembly also includes a guide rail with a spiral section extending downwardly from the cradle to the output ramp. Lastly, a receiving assembly is provided. The receiving assembly includes an input ramp below and a cup above. The plurality of balls are positioned in the cradle for being fed by a player down the guide rail, down the output ramp, up the input ramp into the cup, hopefully.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the invention be regarded as including such equivalent constructions insofar as they do not depart from the spirit and scope of the present invention.

It is therefore an object of the present invention to provide a gravity drop ball game system which has all of the advantages of the prior art golf games of known designs and configurations and none of the disadvantages.

It is another object of the present invention to provide a gravity drop ball game system which may be easily and efficiently manufactured and marketed.

It is further object of the present invention to provide a gravity drop ball game system which is of durable and reliable constructions.

An even further object of the present invention is to provide a gravity drop ball game system which is susceptible of a low cost of manufacture with regard to both materials and labor, and which accordingly is then susceptible of low prices of sale to the consuming public, thereby making such gravity drop ball game system economically available to the buying public.

Lastly, it is another object of the present invention is to provide a gravity drop ball game system which can be used for testing skills of a player and generating competition between players and teams in a safe, convenient, and economical manner.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 7 is a plan view of the dispensing assembly taken along line 7-7 of FIG. 1.

FIG. 8 is an exploded side elevational view of upper region of the dispensing assembly taken along line 8-8 of FIG. 7.

FIG. 9 is a plan view of the dispensing assembly taken along line 9-9 of FIG. 8.

FIG. 10 is an illustration of the five numbered balls.

FIG. 11 is an illustration of the score sheet of the gravity drop five ball golf game of the present invention.

The same reference numerals refer to the same parts throughout the various Figures.

DESCRIPTION OF THE PREFERRED EMBODIMENT

Figures 1, 2:
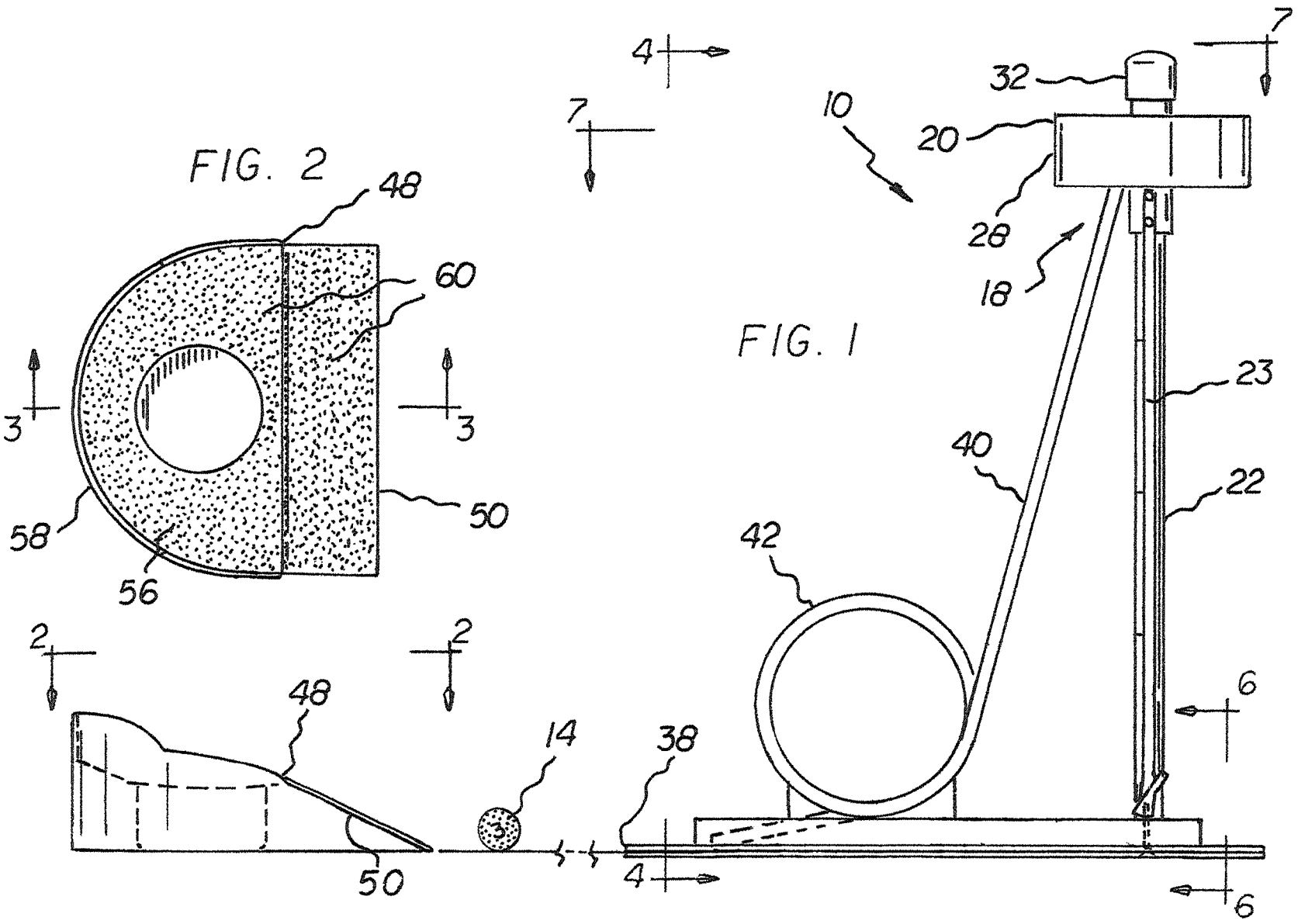
FIG. 1 is a side elevational view of a gravity drop ball game system constructed in accordance with the principles of the present invention.
FIG. 2 is a plan view taken along line 2-2 of FIG. 1.
Figure 3:
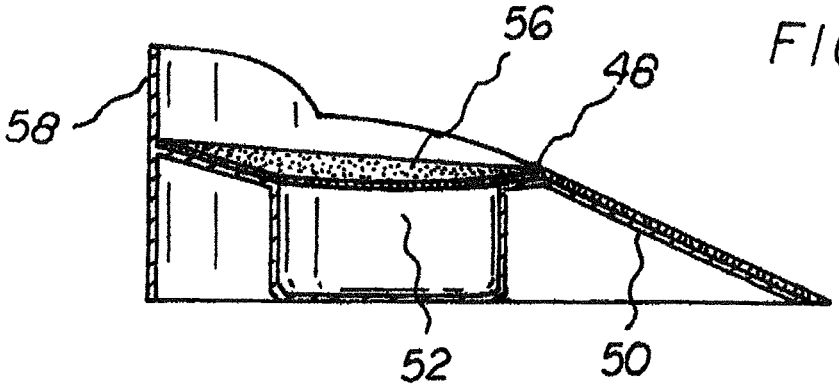
FIG. 3 is a cross sectional view taken along line 3-3 of FIG. 2.
Figure 4:
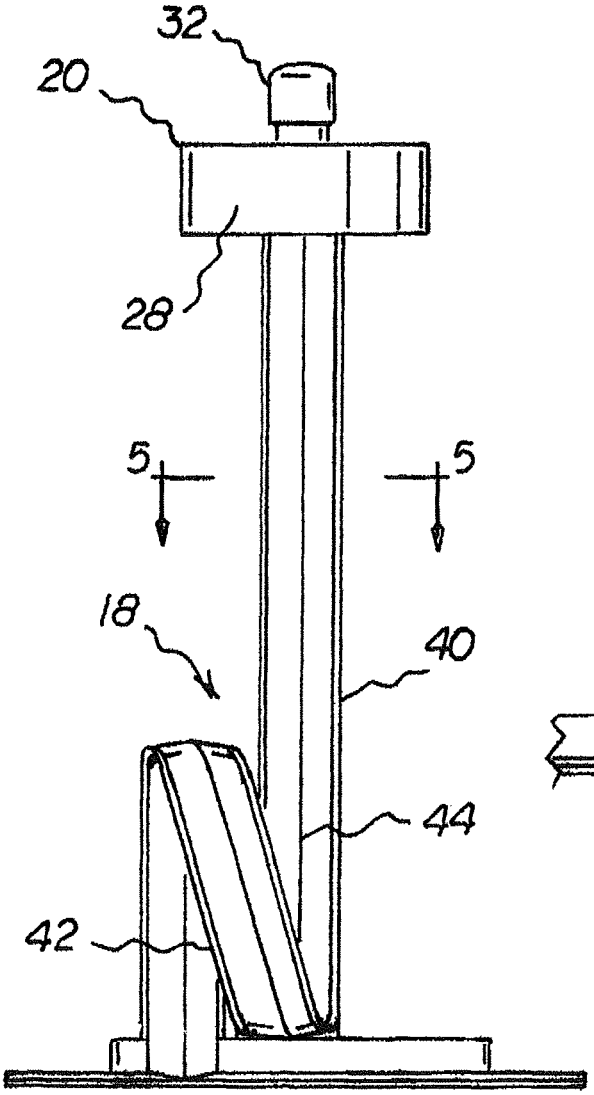
FIG. 4 is a front elevational view of the dispensing assembly taken along line 4-4 of FIG. 1.
Figure 5:
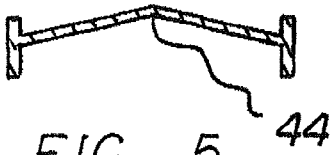
FIG. 5 is a cross sectional view taken along line 5-5 of FIG. 4.
Figure 6:
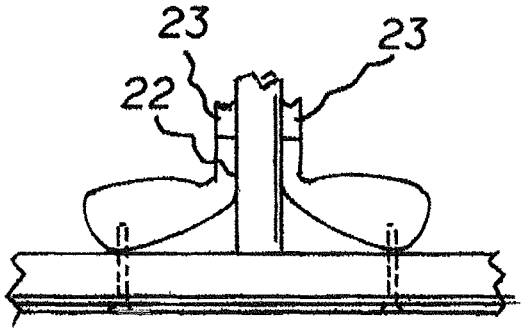
FIG. 6 is a rear elevational view of the lower region of the dispensing assembly taken along line 6-6 of FIG. 1.

With reference now to the drawings, and in particular to FIG. 1 thereof, the preferred embodiment of the gravity drop ball game system embodying the principles and concepts of the present invention and generally designated by the reference numeral 10 will be described.

The present invention, the gravity drop ball game system 10 is comprised of a plurality of components. Such components are individually configured and correlated with respect to each other so as to attain the desired objective. In their broadest context such include a plurality of balls, a dispensing assembly, and a receiving assembly.

The preferred embodiment of the gravity drop five ball golf game system 10 is for testing skills of a player and for generating competition between players and teams in a safe, convenient, and economical manner. In the preferred embodiment, first provided are a plurality of balls 14. The plurality of balls are five in number. Each of the balls is spherical and the balls are of the same diameter and weight. The plurality of balls are individually marked with a unique number 1, 2, 3, 4, and 5.

Next a dispensing assembly 18 is provided. The dispensing assembly is positionable upon a floor surface. The dispensing assembly includes a cradle 20 above for supporting and dispensing the plurality of balls. A support 22 in cylindrical configuration supports the cradle. Additional support for the cradle is provided by two laterally spaced golf clubs 23. The cradle includes a carpeted circular plate 24 with an aperture 26 there through. The aperture has a diameter to allow dropping of a ball there through. The circular plate has a peripheral side wall 28. The cradle also includes a turnstile 30 rotatable upon the carpeted circular plate. The turnstile has a central shaft with a raised knob 32 and six radial plates 34 separated from each other by 60 degrees defining six chambers. Five chambers are adapted to receive one ball leaving one chamber empty over the aperture whereby the raised knob may be rotated by a player to push a ball over the aperture for gravity dropping therefrom.

The dispensing assembly also includes an output ramp 38 below. The dispensing assembly also includes a guide rail 40 with a 360 degree spiral section 42 extending downwardly from the cradle to the output ramp. The guide rail has a central recess 44 along its entire length for guiding the ball during movement.

Lastly, a receiving assembly 48 positionable upon the floor surface is provided. The receiving assembly includes an input ramp 50 below and a cup 52 above. The input ramp is formed in a trapezoidal configuration with an inclined surface at from 20 degrees to 40 degrees from the floor surface. The receiving assembly has a horizontal surface 56 with a peripheral backing 58 in a semi-circular configuration formed as a continuation of the inclined surface with the cup formed centrally within the horizontal surface. Carpeting 60 is provided on the horizontal surfaces and on the input ramp. The plurality of balls is positioned in the chambers for being moved by a player around the cradle, down the guide rail, down the output ramp, across the floor surface, up the input ramp into the cup, hopefully.

Play this FUN Family Game and enjoy the exciting sound of the ball drop, loop shot and back board bank as each ball lands in the cup.

Rules:

1. This game can be played with one or more players, indoors or outdoors. The floor surface should be smooth, clean, dry, and as level as possible. Examples would be a driveway or concrete garage floor, living room, or game room floor.

2. Players can be just about any age, skill or ability level. Age five and up is recommended and this game can be very helpful for those learning addition. We believe that it can also be enjoyed by those who are handicapped. A player would need to be able to turn a knob to the left or right, moving one to five balls around a cradle until one ball drops through the hole. The knob at the ball cradle is approximately 28.5 inches off the floor. A ball pick up tool could be used to put the balls back in the cradle, not included with this game or simply use your hands.

3. Players will have three attempts to reach the highest score by getting the numbered balls into the cup. The game begins when the first player slowly rotates the balls around the ball cradle either to the left or right until a ball drops through. This is continued until all five balls have dropped. The balls are then reloaded into the ball cradle and the next player does the same.

During the game if one or more balls remain on the area near the cup but do not fall in, they do not count. In order for one of these balls to count they must be knocked in by another ball during the current attempt.

4. Each ball is numbered with a 1, 2, 3, 4, or 5. Players add up the numbers on the balls that fall into the cup. The score is recorded after each player completes their attempt.

5. The first player makes one attempt with all five balls. The next player does the same until all players have completed a turn.

6. After all players have made three attempts, you add up the scores and the one with the most points wins the game.

7. In case of a tie, the players who tied will get one attempt with the five balls to get the most points. This continues until the tie is broken. The player with the highest number of points wins the game.

8. The maximum score with each attempt is 15. The maximum score for each game is 45. You don't get your points by the number of balls you get in the cup, you get your points by adding up the numbers on the balls you get in the cup.

9. For normal play, it is recommended that the cup be placed approximately 12 to 14 feet from the ball launch on a smooth floor or six to ten feet on short pile carpet. These distances can be adjusted based on the floor surface and players preferences.

Note: This game is not recommended to be played on thick high pile carpet, nor sand, dirt, grass or other rough surfaces.

For a different game, you can use balls that are not numbered and just add up the number of balls that you get in the cup.

You can also customize the game by having one ball a bonus ball that doubles your points.

You can also redo a drop with one ball, as a mulligan. You can replace the number 3 ball with an un-numbered ball. It would be called a bonus ball with a value of 10 points. When you get it along with the other four numbered balls in the cup, the maximum score with each attempt would be 22.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A gravity drop ball golf game system comprising:

a plurality of balls;

a dispensing assembly including a cradle for supporting and dispensing the plurality of balls, the dispensing assembly also includes an output ramp disposed below the cradle, the dispensing assembly also includes a guide rail with a spiral section extending downwardly from the cradle to the output ramp;

a receiving assembly includes an input ramp and a cup;

wherein the plurality of balls being positioned in the cradle for being fed by a player down the guide rail, down the output ramp, up the input ramp and into the cup;

wherein the plurality of balls includes five balls; and wherein the cradle includes a circular plate with an aperture there through, the aperture having a diameter to allow dropping of a ball there through, the circular plate having a peripheral side wall, the cradle also including a turnstile rotatable upon the circular plate, the turnstile having a central shaft with a raised knob and six radial plates separated from each other by 60 degrees defining six chambers, five of the chambers adapted to receive one ball whereby the raised knob may be rotated by a player to push a ball over the aperture for gravity dropping therefrom.

2. The system as set forth in claim 1, wherein the input ramp is formed in a trapezoidal configuration with an inclined surface at 20 degrees to 40 degrees from a floor surface upon which the input ramp is positionable, the receiving assembly having a horizontal surface with a peripheral backing in a semi-circular configuration formed as a continuation of the inclined surface with the cup formed centrally within the horizontal surface, carpeting on the horizontal surface and on the input ramp.

3. A gravity drop five ball golf game system for testing skills of a player and for generating competition between players and teams, the testing skills and the generating competition being done in a safe, convenient, and economical manner, the system comprising, in combination:

a plurality of balls, the plurality of balls being five in number, each of the plurality of balls being spherical and of a same diameter and weight, the plurality of balls being individually marked with a unique number 1, 2, 3, 4, and 5;

a dispensing assembly positionable upon a floor surface, the dispensing assembly including a cradle for supporting and dispensing the plurality of balls, a support in a cylindrical configuration supporting the cradle, two laterally spaced golf clubs providing additional support for the cradle, the cradle including a circular plate with an aperture there through, the aperture having a diameter to allow dropping of a ball there through, the circular plate having a peripheral side wall the cradle also includes a turnstile rotatable upon the circular plate, the turnstile having a central shaft with a raised knob and six radial plates separated from each other by 60 degrees defining six chambers, five of the chambers adapted to receive one ball whereby the raised knob may be rotated by a player to push a ball over the aperture for gravity dropping therefrom;

the dispensing assembly also including an output ramp disposed below the cradle, the discharge assembly also includes a guide rail with a 360 degree spiral section extending downwardly from the cradle to the output ramp, the guide rail having a central recess along its entire length for guiding the ball during movement; and a receiving assembly positionable upon the floor surface, the receiving assembly including an input ramp and a cup, the input ramp formed in a trapezoidal configuration with an inclined surface at 20 degrees to 40 degrees from the floor surface, the receiving assembly having a horizontal surface with a peripheral backing in a semi-circular configuration formed as a continuation of the inclined surface with the cup formed centrally within the horizontal surface, carpeting on the horizontal surface and on the input ramp, the plurality of balls being positioned in the chambers for being moved by a player around the cradle, down the guide rail, down the output ramp, across the floor surface, up the input ramp into the cup.

* * * * *